US009951955B2

(12) United States Patent
Sandelis et al.

(10) Patent No.: US 9,951,955 B2
(45) Date of Patent: Apr. 24, 2018

(54) ANNULAR COMBUSTION CHAMBER FOR A TURBINE ENGINE

(75) Inventors: Denis Jean Maurice Sandelis, Nangis (FR); Didier Hippolyte Hernandez, Quiers (FR)

(73) Assignee: SNECMA, Paris (FR)

( * ) Notice: Subject to any disclaimer, the term of this patent is extended or adjusted under 35 U.S.C. 154(b) by 419 days.

(21) Appl. No.: 14/118,393

(22) PCT Filed: May 11, 2012

(86) PCT No.: PCT/FR2012/051056

§ 371 (c)(1),
(2), (4) Date: Nov. 18, 2013

(87) PCT Pub. No.: WO2012/156631

PCT Pub. Date: Nov. 22, 2012

(65) Prior Publication Data

US 2014/0090382 A1 Apr. 3, 2014

(30) Foreign Application Priority Data

May 17, 2011 (FR) ..... 11 54302
May 17, 2011 (FR) ..... 11 54303

(51) Int. Cl.
*F23R 3/28* (2006.01)
*F23R 3/14* (2006.01)

(52) U.S. Cl.
CPC ..... *F23R 3/28* (2013.01); *F23R 3/14* (2013.01); *F23R 3/283* (2013.01); *F23R 3/286* (2013.01)

(58) Field of Classification Search
CPC .... F23R 3/14; F23R 3/28; F23R 3/283; F23D 11/107; F23D 2211/00
See application file for complete search history.

(56) References Cited

U.S. PATENT DOCUMENTS 3,811,278 A 5/1974 Taylor et al.
5,488,829 A * 2/1996 Southall ..... F23R 3/12 60/725

(Continued)

FOREIGN PATENT DOCUMENTS

EP 1 873 455 1/2008
EP 1 985 924 10/2008

(Continued)

OTHER PUBLICATIONS

International Search Report dated Jul. 27, 2012 in PCT/FR12/051056 Filed May 11, 2012.

(Continued)

*Primary Examiner* — Craig Kim

(74) *Attorney, Agent, or Firm* — Oblon, McClelland, Maier & Neustadt, L.L.P.

(57) ABSTRACT

An annular combustion chamber for a turbine engine is provided. The chamber includes an annular row of fuel injectors including heads engaged in fuel injection systems mounted in openings in the chamber end wall. Each injector head includes at least one fuel-passing helical channel for causing fuel to rotate about the longitudinal axis of the head. Each injection system includes at least one swirler including air-passing channels of sections with axes that are inclined relative to the plurality axis of the swirler at an angle that is substantially equal to a helix angle of the helical channel, to within ±10°, and are oriented in a same direction as the channel about the longitudinal axis of the swirler.

14 Claims, 6 Drawing Sheets

(56) References Cited

U.S. PATENT DOCUMENTS

| | | | | |
|---|---|---|---|---|
| 6,141,967 | A | 11/2000 | Angel et al. | |
| 6,247,317 | B1 * | 6/2001 | Kostka | F23C 7/002 60/741 |
| 7,334,410 | B2 * | 2/2008 | Creighton | F23R 3/28 60/748 |
| 2007/0068164 | A1 | 3/2007 | Hernandez et al. | |
| 2008/0000234 | A1 | 1/2008 | Commaret et al. | |
| 2009/0049840 | A1 | 2/2009 | Cayre et al. | |
| 2009/0151357 | A1 | 6/2009 | Pieussergues et al. | |
| 2009/0158743 | A1 | 6/2009 | Francis | |
| 2010/0175381 | A1 | 7/2010 | Wilbraham | |
| 2011/0271682 | A1 | 11/2011 | Sandelis | |

FOREIGN PATENT DOCUMENTS

| | | |
|---|---|---|
| EP | 2 072 780 | 6/2009 |
| FR | 2 918 716 A1 | 1/2009 |
| FR | 2 925 146 A1 | 6/2009 |
| FR | 2 941 288 A1 | 7/2010 |
| FR | 2 952 166 | 5/2011 |

OTHER PUBLICATIONS

Office Action dated Aug. 10, 2017 in European Patent Application No. 12728666.4.

* cited by examiner

Fig. 5
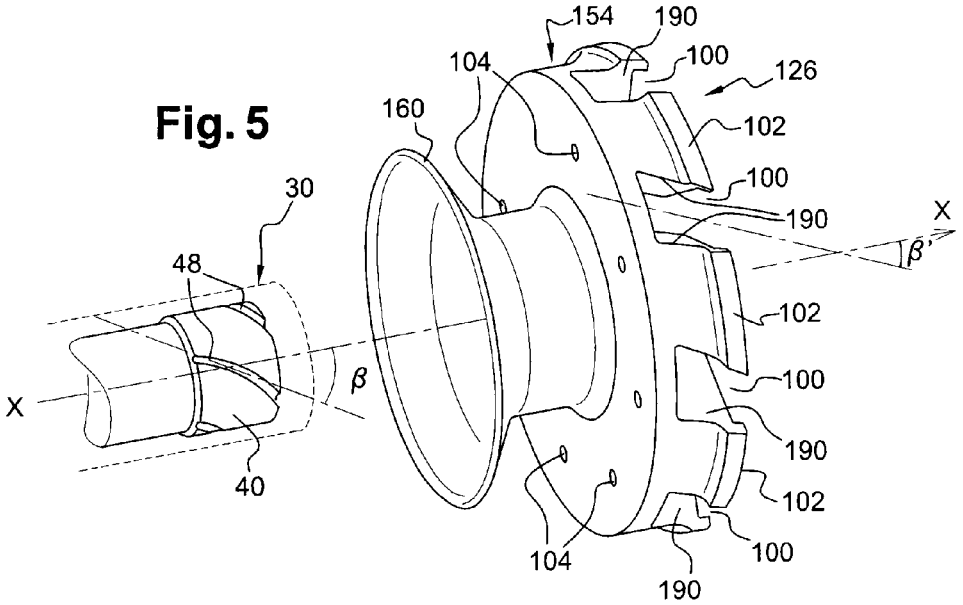
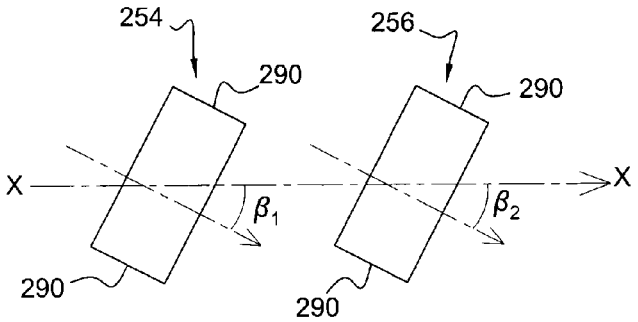
Fig. 6
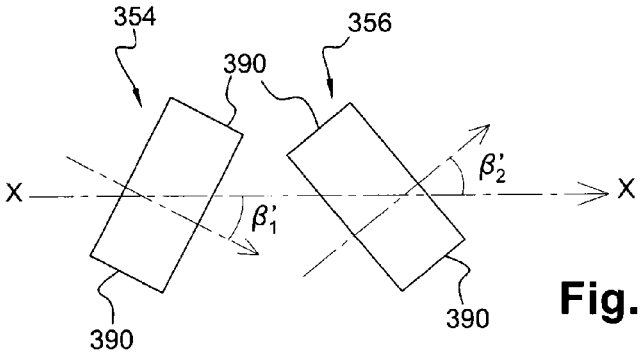
Fig. 7

ANNULAR COMBUSTION CHAMBER FOR A TURBINE ENGINE

BACKGROUND OF THE INVENTION

Field of the Invention

The present invention relates to an annular combustion chamber for a turbine engine, such as an airplane turboprop or turbojet.

Description of the Related Art

An annular combustion chamber comprises inner and outer coaxial annular walls that are connected together at their upstream ends by an annular chamber end wall having openings, each of which receives a fuel injection system.

Applications FR-A1-2 918 716, FR-A1-2 925 146, and FR-A1-2 941 288 describe fuel injection systems for such annular chambers.

A conventional injection system has support and centering means for a fuel injector, and primary and secondary swirlers that are mounted downstream from the support means on the same axis as the support means and each delivering a radial air stream downstream from the injector in order to make an air and fuel mixture for injecting and then burning in the combustion chamber. The air leaving the primary swirler is accelerated in a Venturi interposed between the two swirlers. A mixer bowl of frustoconical shape is mounted downstream from the swirlers for producing a spray of the air/fuel mixture that enters into the combustion chamber.

The swirlers of the injection system have respective substantially radial channels that deliver a swirling air stream. In the prior art, those channels have a section of a shape that is square or rectangular with a longitudinal axis, their upstream and downstream faces being perpendicular to the longitudinal axis and those faces being connected together by lateral faces that are parallel to said axis.

The combustion chamber has an annular row of fuel injectors extending around the longitudinal axis of the chamber. Each injector has one or two fuel circuits, each feeding a helical channel situated in the head of the injector, the helical channel serving to set the fuel into rotation about the longitudinal axis of the injector head and to produce a sheet of fuel in which the speed vectors of the sprayed droplets of fuel are all oriented in the same direction (clockwise or counterclockwise) relative to the longitudinal axis of the injector head and in which they all form the same angle relative to said longitudinal axis. This angle is substantially equal to the helix angle of the above-mentioned helical channel, i.e. to the angle formed between a tangent at a point of the helical channel and the longitudinal axis of the injector head.

The head of each injector is engaged axially in the above-mentioned support means of an injection system, these support means having axial air-purge orifices that open out radially inside the primary swirler for the purpose of ventilating the Venturi.

In the prior art, the air stream leaving these purge orifices disturbs the swirling air stream delivered by the primary swirler, thereby giving rise to turbulence and to recirculation of the air/fuel mixture in the Venturi, and that leads to soot and coke becoming deposited on the inside surface of the Venturi.

This deposit can also impede injecting the air/fuel mixture into the chamber and can create local hot points inside the chamber, thereby encouraging in particular the emission of harmful gases such as nitrogen oxides (NOx).

BRIEF SUMMARY OF THE INVENTION

A particular object of the invention is to provide a solution to this problem that is simple, effective, and inexpensive.

To this end, the invention provides an annular combustion chamber for a turbine engine, the chamber having inner and outer coaxial annular walls connected together at their upstream ends by an annular wall forming a chamber end wall, and an annular row of fuel injectors having heads engaged in fuel injection systems mounted in openings in the chamber end wall, each injector head including at least one fuel-passing helical channel for causing fuel to rotate about the longitudinal axis of the head, and each injection system having at least one swirler on the same axis as the injector head and having substantially radial air-passing channels of elongate section presenting respective longitudinal axes, the combustion chamber being characterized in that the longitudinal axes of the sections of the channels are inclined relative to the longitudinal axis of the swirler at an angle that is substantially equal to the helix angle of the above-mentioned helical channel of the injector head, to within ±10°, and are oriented in the same direction as said channel about the longitudinal axis of the swirler.

The axes of the sections of the swirler channels are thus substantially parallel, to within ±10°, to the speed vectors of the fuel droplets sprayed into the injection system, thereby enabling the air stream delivered by the swirler to shear the sheet of fuel while limiting recirculation of the air/fuel mixture downstream from the swirler and limiting the risk of coke being deposited on the inside surface of the Venturi. In a particular embodiment of the invention, the axes of the sections of the swirler channels are inclined at an angle that is substantially equal to the helix angle of the helical channel of the injector head.

By way of example, the axes of the sections of the channels of the swirler are inclined at an angle lying in the range 20° to 40° approximately relative to the longitudinal axis of the swirler.

Each fuel injector may comprise a first fuel circuit feeding a helical channel and a second fuel circuit that is independent and that feeds another helical channel on the outside, i.e. of diameter greater than that of the first helical channel, which is on the inside. These fuel circuits deliver two sheets of fuel on a common axis, both sheets being of conical shape and the two sheets having different cone angles. The fuel sheet with the smaller cone angle may be optimized for starting the engine and for operating at full throttle, and the second sheet with the larger cone angle may be optimized for the range of speeds extending from starting to full throttle. The axes of the sections of the swirler channels are preferably inclined at the same angle and in the same direction as the outer helical channel for producing the fuel sheet having the larger cone angle.

Each channel of the swirler may have a section of a shape that is square, rectangular, or lozenge-shaped.

Preferably, the swirler is made integrally with the support means for the injection system.

The swirler may have a cylindrical peripheral rim at its downstream end for attaching to a Venturi situated downstream from the swirler.

The channels of the swirler are separated from one another by vanes. Each of these vanes may comprise at least one air-passing through orifice that is inclined relative to the longitudinal axis of the swirler by substantially the same angle and in the same direction as the axes of the sections of the channels situated on either side of the vane. These orifices communicate with through orifices formed in the Venturi for passing a stream of air that is to flow along the outer surface of the Venturi and the inner surface of the bowl.

These orifices enable a film of air to be created for purging the diverging portion of the bowl in order to prevent coke and soot being deposited thereon. The axial orifices of the swirler are fed with air coming directly from the diffuser, which is advantageous. In the prior art, the film of air comes from radial orifices formed in a cylindrical wall of the Venturi, and that air needs to flow past the upstream swirler and feed these orifices statically, thereby reducing the effectiveness with which the bowl is purged and encouraging air recirculation.

In an embodiment of the invention in which each injection system has two swirlers, respectively an upstream swirler and a downstream swirler, and the mixer bowl has at least one annular row of air-passing orifices for passing air that is to mix with the fuel, the axes of the sections of the upstream swirler channels are inclined at the same angle and in the same direction as the helical channel of the injector head, and the axes of the sections of the downstream swirler channels are oriented in the same direction as the helical channel of the injector head.

When the mixer bowl has orifices of the above-specified type, it is advantageous for the air streams delivered by the swirlers to flow in the same direction as the speed vectors of the droplets in the sheet of fuel. Furthermore, the angle between the axes of the sections of the downstream swirler channels and the longitudinal axis of the swirler may be identical to or different from the angle between the axes of the sections of the upstream swirler channels and the longitudinal axis.

In a variant of the invention in which each injection system comprises two swirlers, respectively an upstream swirler and a downstream swirler, and a mixer bowl having no air-passing orifices for passing air that is to mix with the fuel, the axes of the sections of the upstream swirler channels are inclined at the same angle and in the same direction as the helical channel of the injector head, and the axes of the sections of the downstream swirler channels are oriented about the longitudinal axis of the swirler in the direction opposite to the helical channel of the injector head.

When the mixer bowl does not have orifices of the above-specified type, it is advantageous for the air stream delivered by the upstream swirler to flow in the same direction as the speed vectors of the fuel droplets, and for the air stream delivered by the downstream swirler to flow against those speed vectors so that the air stream delivered by the downstream swirler stabilizes the flame in the combustion area of the combustion chamber. Furthermore, the angle between the axes of the sections of the downstream swirler channels and the longitudinal axis of the swirler may be identical to the angle between the axes of the sections of the upstream swirler channels and said axis.

The channels of the swirler are separated from one another by vanes and they may be contained in a radial plane. The trailing edges or radially inner ends of the vanes advantageously extend over a frustoconical surface that flares downstream about the longitudinal axis of the injection system.

The swirling air stream delivered by the swirler of the injection system is both for sweeping and ventilating the head of the injector and the Venturi, and also for mixing with the fuel injected into the chamber. In addition to its main function, the swirler thus also performs a function similar to that of the purge orifices of the prior art, and can therefore be considered as a "purging" swirler. The injection system thus advantageously does not have purge orifices of the above specified type, thereby making it possible to eliminate the turbulence associated in the prior art with the interaction between the air streams leaving the purge orifices and the airstreams leaving the swirler, and also eliminating any risk of coke becoming deposited on the Venturi as a result of such turbulence.

The trailing edge of each vane of the swirler may have a surface that is curved (inwardly concave) and outwardly inclined from upstream to downstream. The frustoconical surface over which the trailing edge is extended has a cone angle of about 45° to 65°, for example, which corresponds substantially to the cone angle of the sheet of fuel sprayed by the injector into the system. The trailing edges of the vanes thus extend parallel to the outer peripheral surface of the sheet of fuel, thereby facilitating mixing of the air and the fuel in the Venturi.

Furthermore, eliminating the purge orifices makes it possible to reduce the number of orifices in the injection system compared with prior art injection systems and to increase the diameter of the remaining orifices for given permeability of the system (where permeability is equal to the sum of the effective sections of the orifices and of the air-passing channels of the system), thus making them easier to machine and reducing the cost of making them, and also making it possible to make an injection system of small diameter for a turbine of small size.

Each injection system may comprise a Venturi and a mixer bowl situated downstream from the swirler, the swirler serving to ventilate the Venturi by guiding the stream of air leaving the swirler along the inner surface of the Venturi.

Preferably, the swirler has a cylindrical peripheral rim at its downstream end for attaching to the Venturi.

Each injection system may comprise support and centering means for an injector head, these support means comprising an inner cylindrical surface that is to surround the head of the injector and that is connected at its downstream end to the smaller-diameter upstream end of the above-mentioned frustoconical surface.

The present invention also relates to a turbine engine such as an airplane turboprop or turbojet, characterized in that it includes a combustion chamber as described above.

BRIEF DESCRIPTION OF THE SEVERAL VIEWS OF THE DRAWINGS

The invention can be better understood and other characteristics, details, and advantages thereof appear more clearly on reading the following description made by way of non-limiting example and with reference to the accompanying drawings, in which:

FIG. 5 is a fragmentary diagrammatic view in perspective of an injector head and an injection system for a combustion chamber of the invention;

FIGS. 6 and 7 are very diagrammatic views showing the orientations of channel sections for passing air in the swirlers of an injection system of the invention in variant embodiments of the combustion chamber of the invention;

DETAILED DESCRIPTION OF THE INVENTION

Figure 1:
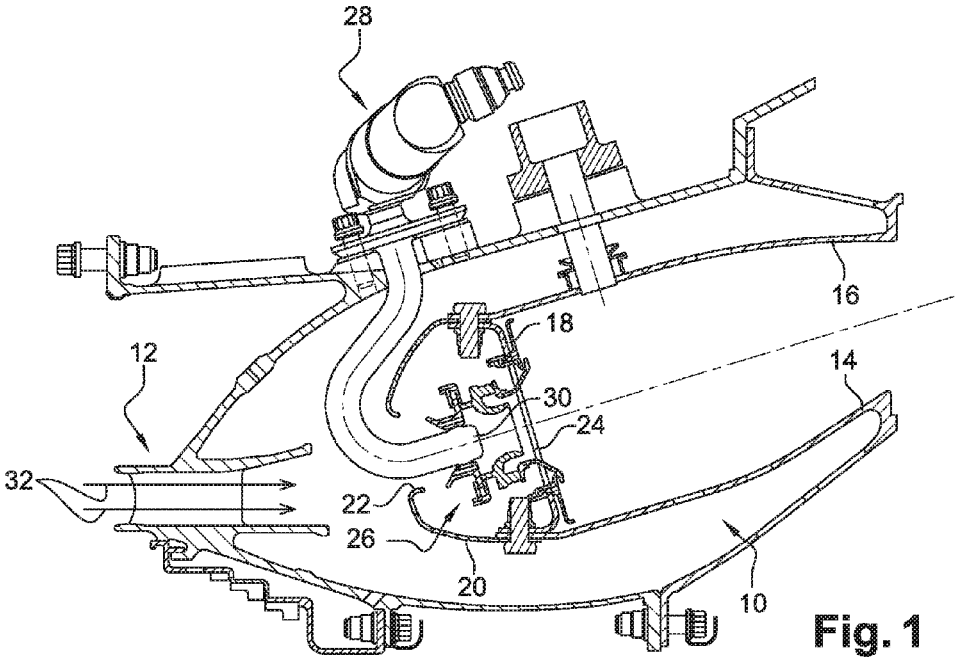
Fig. 1 Related Art
FIG. 1 is a diagrammatic half-view in axial section of a diffuser and an annular combustion chamber of a turbine engine, in the prior art.

FIG. 1 shows an annular combustion chamber 10 of a turbine engine, such as an airplane turboprop or turbojet, the chamber being arranged at the outlet from a diffuser 12, itself situated at the outlet from a compressor (not shown).

The chamber 10 has an inner wall 14 and an outer wall 16, both forming bodies of revolution, that are connected together upstream by an annular wall 18 forming a chamber end wall.

An annular fairing 20 is fastened to the upstream ends of the chamber walls 14 and 16 and it includes openings 22 for passing air that are in alignment with openings 24 in the chamber end wall 18 in which fuel injection systems 26 are mounted, the fuel being conveyed by injectors 28 that are regularly distributed around the axis of the chamber.

A fraction of the air flow 32 delivered by the compressor and leaving the diffuser 12 penetrates into the annular enclosure defined by the fairing 20, passes into the injection system 26, and is then mixed with the fuel conveyed by the injector 28 and sprayed into the combustion chamber 10.

Each injector 28 has a fuel injection head 30 engaged in an injection system 26 and in alignment on the axis of an opening 24 in the chamber end wall 18.

Figure 2:
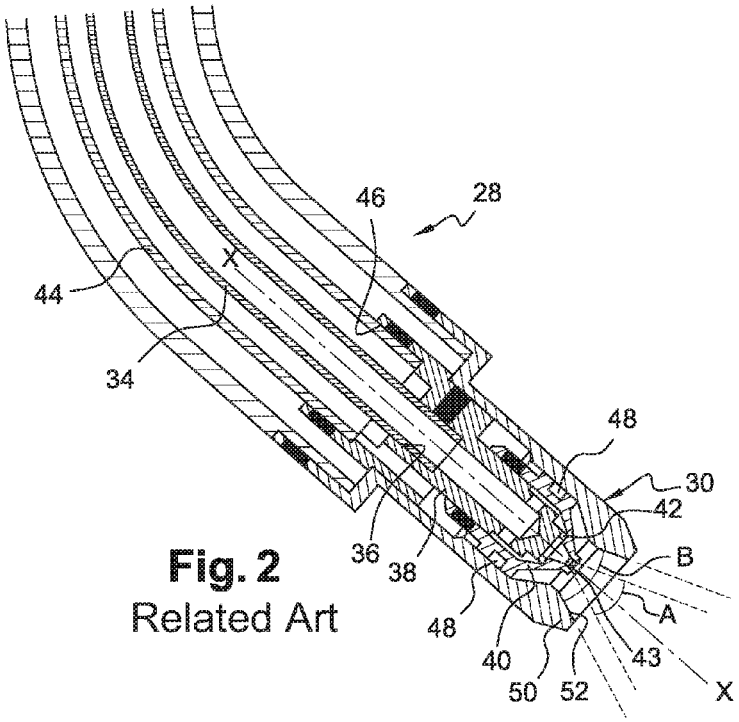
Fig. 2 Related Art
FIG. 2 is a fragmentary diagrammatic view in axial section of a fuel injector for a turbine engine combustion chamber.

FIG. 2 is on a larger scale and shows the head 30 of a fuel injector 28 of the type having two fuel circuits, as described in detail in the Applicants' application FR-A1-2 817 016, the contents of which are incorporated herein its entirety by reference.

The first fuel circuit of the injector 28 comprises a feed tube 34 having one end engaged and fastened in a cylindrical bore 36 in a cylindrical part 38 that is itself mounted inside a sleeve 40. Fuel is conveyed by the tube into the bore 36 of the part 38 and it then flows in helical channels 42 opening out in the downstream free end of the part 38 in order to set the fuel into rotation about the longitudinal axis XX of the injector head. The downstream free end of the sleeve 40 is situated downstream from the cylindrical part 38 and has a fuel ejection orifice 43 with a downstream end portion that is of frustoconical section to form a conically-shaped sheet of fuel with a predetermined cone angle A.

The second fuel circuit of the injector 28 has a feed tube 44 of larger diameter than the tube 34 and coaxially arranged thereabout, with one end engaged and fastened in a cylindrical bore 46 of the cylindrical part 38, this bore 46 being in fluid flow communication with helical channels 48 in the above-mentioned sleeve 40. The channels 48 are formed by outer helical grooves formed in an outer cylindrical surface of the sleeve 40 and closed by a cylindrical endpiece 50 surrounding the cylindrical part 38, the sleeve 40, and the downstream end portions of the tubes 34 and 44.

The fuel is set into rotation about the longitudinal axis XX on passing along the channels 48 that open out in the downstream end of the sleeve 40. The downstream free end of the endpiece 50 is situated downstream from the sleeve 40 and includes a fuel ejection orifice 52 coaxial about the orifice 42 and having a downstream end portion of frustoconical section to form a conically-shaped sheet of fuel with a predetermined cone angle B (where B is greater than A).

Each sheet of fuel produced by an injector 28 is made up of a multitude of droplets having speed vectors that are substantially all oriented in the same direction relative to the longitudinal axis XX of the injector head. The speed vectors of these droplets are at an angle β (beta) relative to the axis XX, this angle β being substantially equal to the helix angle of the above-mentioned helical channels 42 or 48 that deliver the sheet of fuel. The fuel droplets have a size lying in the range 10 micrometers (μm) to 100 μm, approximately.

Figure 3:
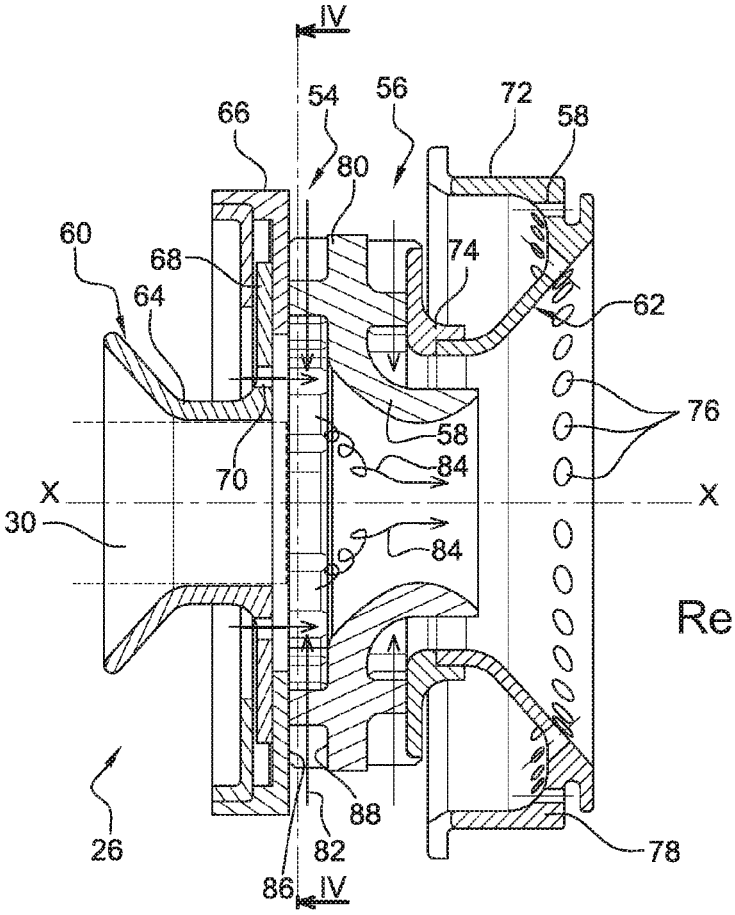
Fig. 3 Related Art
FIG. 3 is a view on a larger scale of the FIG. 1 injection system.

As can be seen more clearly in FIG. 3, a prior art injection system 26 has two swirlers on the same axis, an upstream or inner swirler 54 and a downstream or outer swirler 56, which swirlers are separated from each other by a Venturi 58 and are connected upstream to support means 60 for supporting the head 30 of an injector 28, and downstream to a mixer bowl 62 that is mounted axially in the opening 24 of the chamber end wall 18.

Each of the swirlers 54, 56 has a plurality of vanes extending substantially radially around the axis XX of the swirlers and regularly distributed around this axis in order to deliver the swirling streams of air downstream from the injection head 30. Between them, the vanes define air-passing channels that are inclined or curved around the axis XX of the swirlers.

The support means 60 for the injection head 30 comprise a ring 64 having the injection head 30 passing axially therethrough and slidably mounted in a bushing 66 fastened on the inner swirler 54. The ring 64 has an annular rim 68 extending radially outwards and received in an annular groove of the bushing 66, the inside diameter of the groove in the bushing 66 being greater than the outside diameter of the rim 68 on the ring 64.

The rim 68 of the ring 64 has substantially axial purge orifices 70 for passing a stream of air for sweeping the head 30 of the injector in order to prevent flame returning towards the injector in operation.

The mixer bowl 62 has a substantially frustoconical wall that flares downstream and that is connected at its downstream end to a cylindrical rim 72 that extends upstream and that is mounted axially in the opening 24 in the chamber end wall 18. The upstream end of the frustoconical wall of the bowl 62 is connected to an intermediate annular part 74 fastened on the outer swirler 56.

The frustoconical wall of the bowl 62 has an annular row of air-passing orifices 76 extending around the axis XX. In the vicinity of its rim 72, the bowl 62 also has a second annular row of air-passing orifices 78, this air serving to impact against an annular collar that extends radially outwards from the downstream end of the frustoconical wall of the bowl.

The Venturi 58 has a substantially L-shaped section and at its upstream end it has an outer annular rim 80 extending radially towards and interposed axially between the two swirlers 54 and 56. The Venturi 58 extends axially downstream inside the outer swirler 56 and separates the air flows coming from the inner and outer swirlers 54 and 56.

On the inside, the Venturi 58 defines a pre-mixer chamber in which a portion of the injected fuel mixes with the air stream delivered by the inner swirler 54, this air/fuel pre-mixture then mixing downstream from the Venturi with the stream of air coming from the outer swirler 56 in order to form a cone of sprayed fuel inside the chamber.

Figure 4:
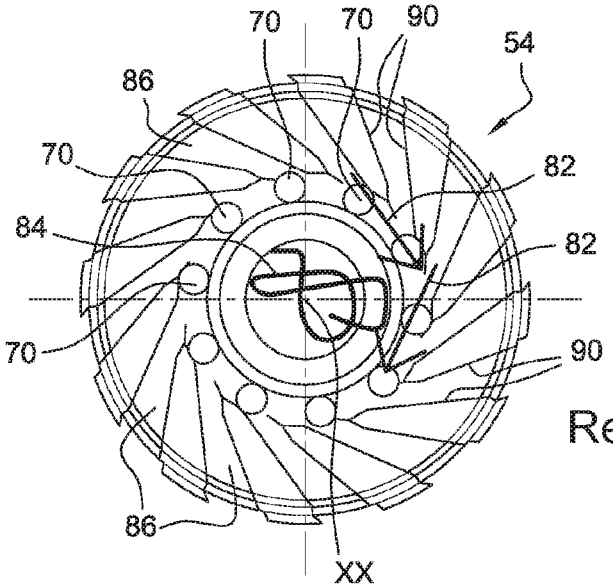
Fig. 4 Related Art
FIG. 4 is a section view on line IV-IV of FIG. 3.

As shown in FIG. 4, the number of vanes in the inner swirler 54 is different from the number of purge orifices 70, and the angular positions of the orifices and of the vanes around the axis XX are randomly defined.

In the prior art, each channel of the swirlers 54 and 56 has a section that is square or rectangular in shape with an upstream face 86 and a downstream face 88, which faces are connected together by lateral faces 90 extending parallel to the axis XX of the injection system.

The air stream 82 delivered by the swirler and the air stream leaving the purge orifices 70 cross, thereby giving rise to recirculation 84 and to azimuth non-uniformities in the flow of air feeding the Venturi 58, so the shearing of the sheet of fuel by the air stream 82 is not optimized.

The invention enables these problems to be remedied by an injection system 126 as shown in FIG. 5, in which the channels 100 of the swirler 154 (the upstream swirler in a system having two swirlers) are of elongate sections presenting a longitudinal axis parallel to the lateral faces 190 of the channels and inclined at an angle β' relative to the axis XX of the swirler, where the angle β' is substantially equal (to within ±10°) to the helix angle β of the above-mentioned helical channels 48 of the injection head 30 and to the speed vectors of the fuel droplets in the sheets produced by those channels.

The air stream delivered by the swirler 154 is parallel with and flows in the same direction as the speed vectors of the fuel droplets in the sheet, thereby enabling the air stream to shear the sheet while limiting any risk of recirculation of the air/fuel mixture and any risk of coke being deposited on the Venturi (not shown) situated downstream from the swirler.

In the example shown, the support means 160 for the injector head 30 are made integrally with the swirler 154, which has an outer peripheral rim 102 at its downstream end for attaching to the Venturi.

The lateral walls 190 of each channel 100 in the swirler 154 are connected together at their upstream end by an upstream wall that is perpendicular to the axis XX. The channels 100 are closed downstream by an upstream radial face of the Venturi that defines the downstream walls of the channels 100, these downstream walls of the channels being perpendicular to the axis XX.

The channels 100 of the swirler 154 are separated from one another by substantially radial vanes that are pierced with purge orifices 104 passing through the swirler all along its axial length. These purge orifices 104 open out at their upstream ends in an upstream radial face of the swirler 154, and their downstream ends communicate with corresponding orifices of the Venturi for passing a purge air stream over the outer surface of the Venturi and the inner frustoconical surface of the mixer bowl situated downstream from the Venturi, the Venturi and the mixer bowl of the injection system of the invention being similar to those shown in FIG. 3. The purge orifices 104 are inclined at the same angle β' about the axis XX.

When the injection system of the invention has two swirlers on the same axis together with a mixer bowl (as shown in FIG. 3), the axes of the sections of the channels in the swirlers may be oriented to cross the axis XX in the same direction or in opposite directions, as shown diagrammatically in FIGS. 6 and 7.

The cross-sections of an upstream swirler channel and of a downstream swirler channel are represented diagrammatically in FIGS. 6 and 7 by rectangles.

In FIG. 6, the axes of the sections of the upstream and downstream swirler channels 254 and 256 are oriented in the same direction and they deliver air streams flowing in the same direction as the speed vectors of the droplets in the sheet of fuel. The angle β1 between the axes of the sections of the upstream swirler channels 254 and the axis XX is substantially equal, to within ±10°, to the above-mentioned angle between the speed vectors of the droplets and the axis XX, and the angle β2 between the axes of the sections of the downstream swirler channels 256 and the axis XX is equal to β1 or is different from β1. This embodiment of the invention is particularly adapted to an injection system in which the mixer bowl has air-passing orifices for air that is to mix with the fuel in operation, i.e. orifices of the same type as those referenced 76 in FIG. 3.

In FIG. 7, the axes of the sections of the upstream and downstream swirler channels 354 and 356 are oriented in opposite directions and they deliver respective air streams flowing together with and against the speed vectors of the drops in the sheet of fuel. The angle β1' between the axes of the sections of the upstream swirler channels 354 and the axis XX is substantially equal, to within ±10°, to the above-mentioned angle between the speed vectors of the droplets and the axis XX, and the angle β2' between the lateral faces 390 of the downstream swirler channels 356 and the axis XX is substantially equal to β1'. This embodiment of the invention is particularly adapted to an injection system in which the mixer bowl does not have air-passing orifices for passing air that is to mix with the fuel in operation, i.e. orifices of the type referenced 76 in FIG. 3. The air stream delivered by the downstream swirler is then used to stabilize the flame in the combustion chamber.

The above-mentioned injection system may comprise a purging swirler both for sweeping the head of the injector and the inner surface of the Venturi (and thus form a purging function) and also for mixing with the fuel brought in by the injector.

The purging swirler of the invention comprises substantially radial vanes with radially inner trailing edges that are inclined outwards from upstream to downstream and that extend over a frustoconical surface flaring downstream around the axis A of the injection system.

The purging swirler is contained in a radial plane. The channels of the swirler have upstream and downstream radial faces that are substantially parallel to one another and to a transverse plane perpendicular to the axis A of the injection system.

Figure 8:
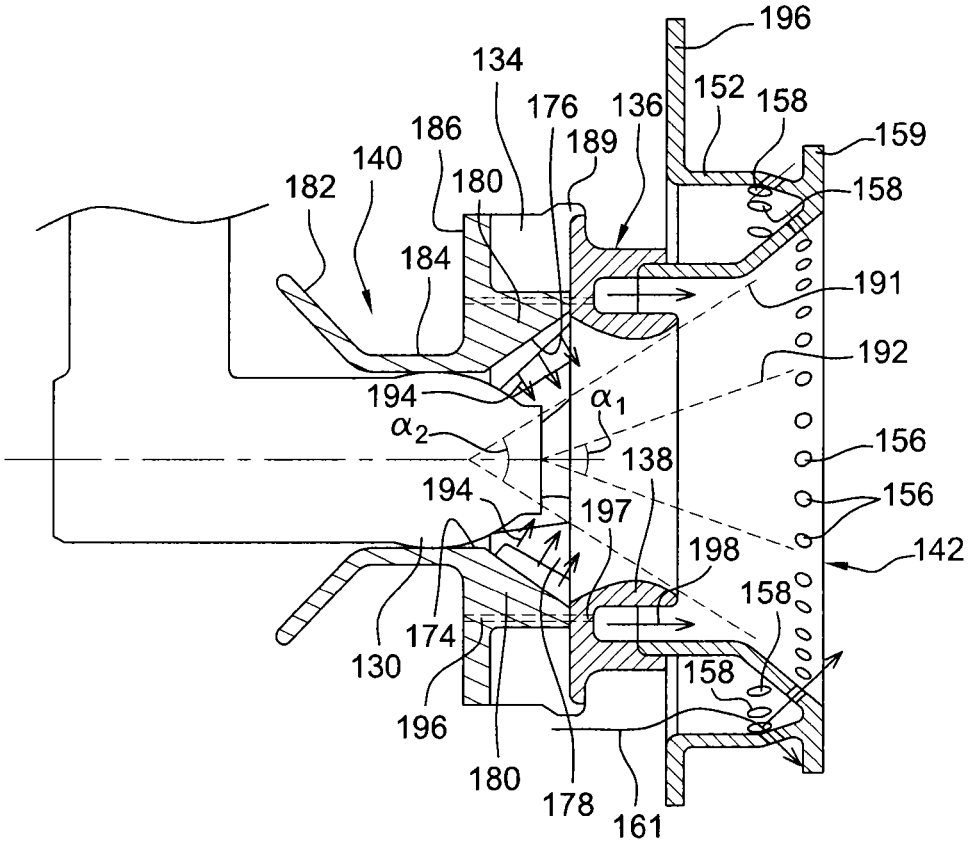
FIG. 8 is a diagrammatic axial section view of an injection system of the invention.
Figure 9:
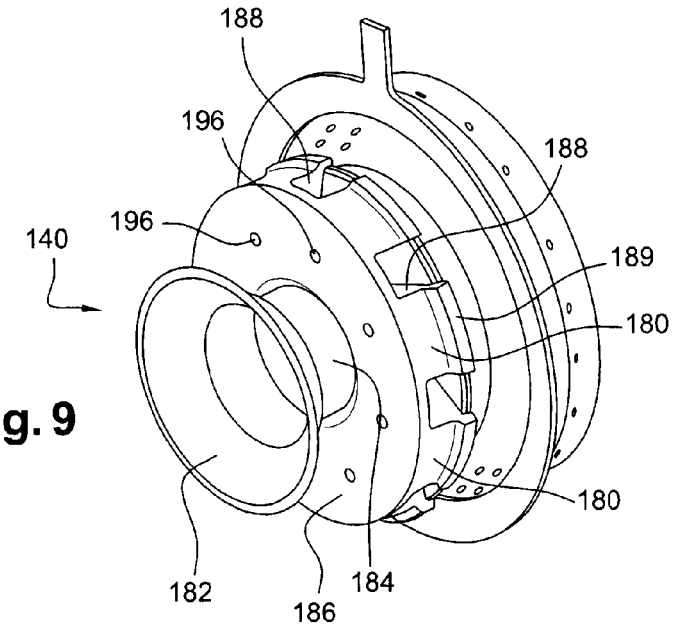
FIG. 9 is a diagrammatic perspective view of the FIG. 8 injection system seen from upstream and from the side.
Figure 10:
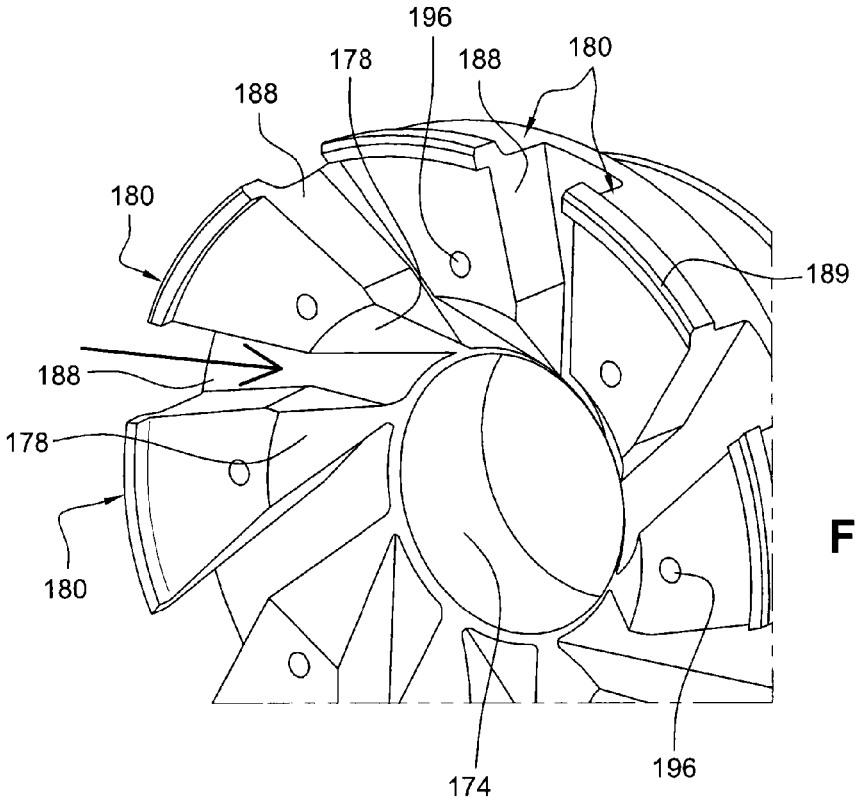
FIG. 10 is a diagrammatic perspective view of the swirler of the FIG. 8 injection system seen from upstream and from the side.

In the example shown in FIGS. 8 to 10, the support means 140 sporting the head 130 of the injector and the upstream or inner swirler 134 are made as a single part.

The support means 140 comprise an inner cylindrical surface 174 with a downstream end that is connected to the upstream end of the frustoconical surface 176 that is defined by the trailing edges 178 of the vanes 180 of the swirler 134. As can be seen more clearly in FIG. 10, the trailing edge 178 of each vane 180 has a surface that is curved (inwardly concave) and outwardly inclined from upstream to downstream.

The support means 140 have a cylindrical wall 184 defining internally the above-mentioned cylindrical surface 174 that is connected at its upstream end to a frustoconical wall 182 flaring upstream, and at its downstream end to a radial wall 186 that extends outwards.

The vanes 180 of the swirler 134 are connected at their upstream ends to the radial wall 186 of the support means 140. The channels 188 defined by the vanes 180 of the swirler are formed by slots leading axially downstream and closed by an upstream radial face of a Venturi 138 separating the swirler 134 from the bowl 142.

Furthermore, at their downstream ends, the vanes 180 have cylindrically-shaped outer peripheral rims 189 that serve for centering and attaching the swirler on the Venturi 138. Each vane 180 of the swirler 134 has an outer peripheral rim forming a portion of a cylinder (FIGS. 9 and 10).

As shown in FIG. 8, the trailing edges 178 of the vanes of the swirler 134 extend parallel to the outer peripheral surface of the sheet of fuel 191 that is delivered in the form of a cone by the injector.

When the injector is fitted with two fuel circuits, it can deliver two coaxial sheets of fuel, a first fuel sheet 192 in the form of a cone having a cone angle $\alpha 1$ and a second fuel sheet 191 that is coaxial, in the form of a cone having a cone angle $\alpha 2$ (greater than $\alpha 1$). The first fuel sheet 192 may be optimized for starting the engine and for operating at full throttle, and the second sheet 191 may be optimized for the range of speeds extending from starting to full throttle.

Advantageously, the trailing edges 178 of the vanes 180 of the swirler 134 are parallel to the outer peripheral surface of the second sheet of fuel 191, and thus form an angle $\alpha 2$ with the axis A, where $\alpha 2$ device example in the range 45° to 65°.

The trailing edges 178 of the vanes 180 are situated at the same distance from the outer peripheral surface of the sheet 191. The momentum of the air stream delivered by the swirler 134 is constant over the entire axial dimension of the swirler. This stream of air shears the fuel sheet 191 in identical manner over the entire axial extent of the swirler. Furthermore, the portion 194 of the air stream leaving via the upstream end portions of the trailing edges 178 of the vanes 180 serves to purge the end of the head 130 of the injector and to shear the sheet of fuel 191 without disturbance.

In the example shown, the channels 188 of the swirler 134 have a section that is square in shape and constant over the entire radial dimension of the swirler.

As can be seen in FIGS. 8 to 10, an axial orifice 196 for passing air is formed in each vane 180 and communicates with an axial orifice 197 for passing air in the Venturi 138. At their upstream ends, the orifices 196 open out in the upstream radial face of the radial wall 186 of the centering means, and at their downstream ends the orifices 197 open out radially to the outside of the Venturi 138. The air 198 leaving the orifices 197 is for flowing over the outer surface of the Venturi and for forming a film of air for purging the radially inner surface of the bowl 142, in order to prevent coke from being deposited on the surface.

The mixer bowl 142 of the injection system is mounted downstream from the swirler 136 and, as in the prior art, it includes a substantially frustoconical wall that flares downstream and that is connected at its upstream end to a cylindrical rim 152 that extends upstream. The frustoconical wall has an annular row of air-passing orifices 156 extending around the axis A. The rim 152 includes an annular row of air-passing orifices 158, this air being for impacting against an annular collar 159 that extends radially outwards from the downstream end of the frustoconical wall of the bowl.

The rows of orifices 156, 158 are situated on circumferences having diameters that are substantially equal to or greater than the maximum outside diameters of the support means 140 and of the swirler 134. The air stream 161 that feeds these orifices therefore does not go around the injection system, thereby limiting the disturbances to this stream and optimizing the air feed to the orifices 156, 158.

By eliminating the purge orifices, and for a given permeability of the injection system, the invention makes it possible to optimize accurately the diameters of the orifices 156, 158 in the mixer bowl and the dimensions of the channels in the swirlers 134, 136. In a particular embodiment of the invention, the combined sections of the orifices 158 in the mixer bowl and of the channels in that the outer swirler 136 represent 20% to 30% of the total permeability of the system, with the combined sections of the orifices 156 in the mixer bowl and of the channels 188 in the inner swirler 134 representing 70% to 80% of this permeability. 70% to 80% of the flow of air feeding the injection system thus serves to mix with the fuel delivered by the injector.

Figure 11:
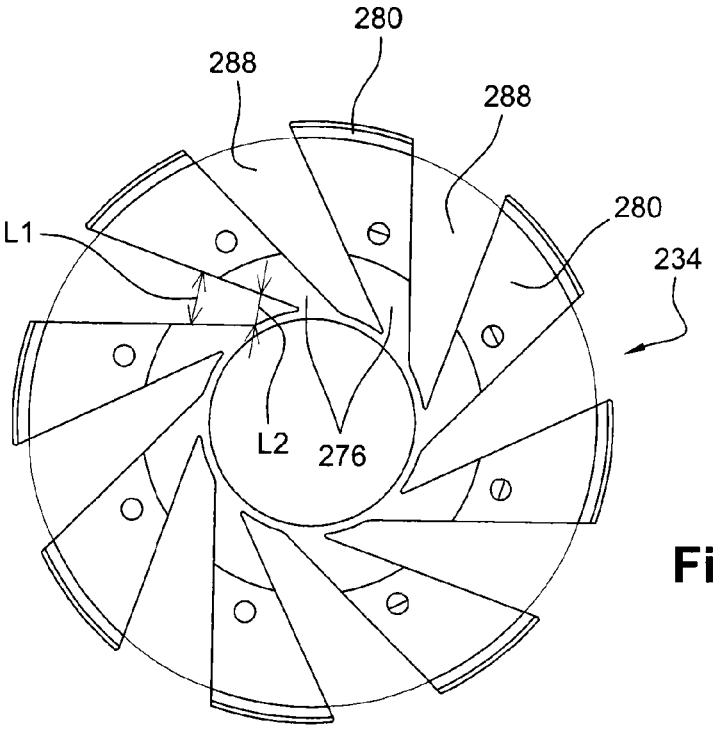
FIG. 11 is a view from the downstream face of a swirler in a variant embodiment of the injection system of the invention.
Figure 12:
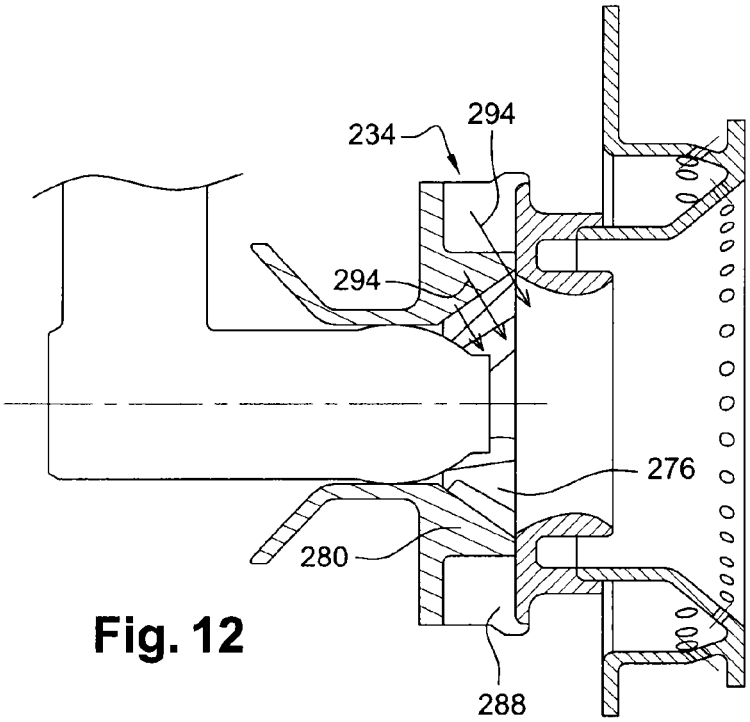
FIG. 12 is a view corresponding to FIG. 8 and showing the FIG. 11 variant embodiment of the injection system.

In the variant embodiment of FIGS. 11 and 12, the injection system differs from that described above in that the channels 288 of its inner swirler 234 are of a section that decreases going radially from the outside towards the inside.

The width L1 or circumferential dimension of each channel 288 at the downstream ends of the trailing edges 276 of the vanes 280 extending on either side of the channel is greater than the width of the same channel at the upstream ends of the above-mentioned trailing edges (FIG. 11).

The air outlet section at the trailing edges 276 of the vanes 280 is thus greater at the downstream ends of the trailing edges than at their upstream ends. Because this section is calibrating, the momentum of the air is greater at the downstream end of the swirler than at its upstream end (arrows 294), and it increases in regular manner between its upstream end and its downstream end because of the increase in the outlet width of the channels between these ends.

In another variant that is not shown, the channels of the inner swirler of the injection system may present a section that is rectangular or trapezoidal in shape, and not square as in the examples described above. In the event of this section being trapezoidal, each vane of the swirler may have its side faces converging from downstream to upstream.

The invention claimed is:

1. An annular combustion chamber for a turbine engine, the chamber comprising:

coaxial annular inner wall and outer wall connected together at upstream ends thereof by an annular wall forming a chamber end wall; and an annular row of fuel injectors including heads engaged in fuel injection systems mounted in openings in the chamber end wall, each injector head having a longitudinal axis and including at least one fuel-passing helical channel which has an axial component parallel to said longitudinal axis for causing fuel to rotate about said longitudinal axis of the injector head, and each injection system including at least one swirler located on a same longitudinal axis as the injector head and including substantially radial air-passing channels having respective longitudinal axes along which each air-passing channel has a longitudinal section, wherein the longitudinal axes of longitudinal sections of the air-passing channels have each an axial component parallel to said longitudinal axis and are inclined relative to said longitudinal axis of the at least one swirler at an angle that is substantially equal to within ±10° of a helix angle of the helical channel of the injector head, and the longitudinal axes of the longitudinal sections, which longitudinal axes have each an axial component parallel to said longitudinal axis, are oriented in a same direction as said at least one fuel-passing helical channel about the longitudinal axis of the at least one swirler, and wherein the air-passing channels are formed by slots closed by an upstream radial face of a venturi and leading axially downstream, and said air-passing channels are separated from one another by substantially radial vanes comprising purge orifices.

2. The annular combustion chamber according to claim 1, wherein each fuel injector includes a first fuel circuit feeding a first helical channel and a second fuel circuit that is independent and that feeds a second helical channel of diameter greater than diameter of the first helical channel, the axes of the sections of the swirler channels being inclined at a same angle and in a same direction as the second helical channel.

3. The annular combustion chamber according to claim 1, wherein, perpendicularly to said longitudinal axis, each channel of the swirler includes a transverse section of a shape that is square or rectangular.

4. The annular combustion chamber according to claim 1, wherein the swirler includes a cylindrical peripheral rim at its downstream end for attaching to the venturi.

5. The annular combustion chamber according to claim 1, wherein the channels of the swirler are separated from one another by vanes, each of the vanes including at least one air-passing through orifice that is inclined relative to the longitudinal axis of the swirler by a same angle and the through orifice is in a same direction as the axes of the sections of the channels situated on either side of the vane.

6. The annular combustion chamber according to claim 1, wherein:

said at least one swirler comprises an upstream swirler and a downstream swirler, the upstream swirler being disposed upstream of the downstream swirler on said longitudinal axis, and each injection system includes a mixer bowl including at least one annular row of air-passing orifices for passing air that is to mix with the fuel, axes of the sections of the upstream swirler channels being inclined at a same angle and in a same direction as the helical channel of the injector head, and axes of the sections of the downstream swirler channels being oriented about the longitudinal axis of the swirler in a same direction as the helical channel of the injector head.

7. The annular combustion chamber according to claim 1, wherein the channels are separated from one another by vanes and are contained in a radial plane, trailing edges or radially inner ends of the vanes extending over a frustoconical surface flaring downstream around the longitudinal axis of the injection system.

8. The annular combustion chamber according to claim 1, wherein each injection system comprises the venturi and a mixer bowl situated downstream from the swirler, the swirler configured to ventilate the venturi by guiding a stream of air leaving the swirler along an inner surface of the venturi.

9. The annular combustion chamber according to claim 1, wherein each injection system comprises support and centering means for an injector head, the support and centering means comprising an inner cylindrical surface that is to surround the head of the injector and that is connected at a downstream end thereof to a smaller-diameter upstream end of a frustoconical surface.

10. A turbine engine comprising an annular combustion chamber according to claim 1.

11. The annular combustion chamber according to claim 1, wherein the air-passing channels include lateral walls parallel to the longitudinal axes of the longitudinal sections, and the lateral walls of each of the air-passing channels are connected together at an upstream end thereof by an upstream wall perpendicular to the longitudinal axis of the swirler.

12. The annular combustion chamber according to claim 11, wherein the air-passing channels are closed at a downstream end thereof by an upstream racial face of the venturi that defines downstream walls of the air-passing channels.

13. An annular combustion chamber for a turbine engine, the chamber comprising:

coaxial annular inner wall and outer wall connected together at upstream ends thereof by an annular wall forming a chamber end wall; and an annular row of fuel injectors including heads engaged in fuel injection systems mounted in openings in the chamber end wall, each injector head having a longitudinal axis and including at least one fuel-passing helical channel which has an axial component parallel to said longitudinal axis for causing fuel to rotate about said longitudinal axis of the injector head, and each injection system including at least one swirler located on a same longitudinal axis as the injector head and including substantially radial air-passing channels having respective longitudinal axes along which each air-passing channel has a longitudinal section, wherein the longitudinal axes of longitudinal sections of the air-passing channels have each an axial component parallel to said longitudinal axis and are inclined relative to said longitudinal axis of the at least one swirler at an angle that is substantially equal to within ±10° of a helix angle of the helical channel of the injector head, and the longitudinal axes of the longitudinal sections, which longitudinal axes have each an axial component parallel to said longitudinal axis, are oriented in a same direction as said at least one fuel-passing helical channel about the longitudinal axis of the at least one swirler, wherein the air-passing channels are formed by slots closed by an upstream radial face of a venturi and leading axially downstream, and said air-passing channels are separated from one another by substantially radial vanes, and wherein said swirler is free of purge orifice.

14. An annular combustion chamber for a turbine engine, the chamber comprising:

coaxial annular inner wall and outer wall connected together at upstream ends thereof by an annular wall forming a chamber end wall; and an annular row of fuel injectors including heads engaged in fuel injection systems mounted in openings in the chamber end wall, each injector head having a longitudinal axis and including at least one fuel-passing helical channel which has an axial component parallel to said longitudinal axis for causing fuel to rotate about said longitudinal axis of the injector head, and each injection system including at least one swirler located on a same longitudinal axis as the injector head and including substantially radial air-passing channels having respective longitudinal axes along which each air-passing channel has a longitudinal section, wherein the longitudinal axes of longitudinal sections of the air-passing channels have each an axial component parallel to said longitudinal axis and are inclined relative to said longitudinal axis of the at least one swirler at an angle that is substantially equal to within ±10° of a helix angle of the helical channel of the injector head, and the longitudinal axes of the longitudinal sections, which longitudinal axes have each an axial component parallel to said longitudinal axis, are oriented in a same direction as said at least one fuel-passing helical channel about the longitudinal axis of the at least one swirler, so as to limit a recirculation of air and fuel mixture downstream from the swirler.

* * * * *